US009683368B1

(12) United States Patent
Campagna

(10) Patent No.: US 9,683,368 B1
(45) Date of Patent: Jun. 20, 2017

(54) ENCOMPASSING MORTARLESS LOCKING BLOCKS

(71) Applicant: Thomas G. Campagna, Selden, NY (US)

(72) Inventor: Thomas G. Campagna, Selden, NY (US)

(73) Assignee: Thomas G. Campagna, Dix Hills, NY (US)

( * ) Notice: Subject to any disclaimer, the term of this patent is extended or adjusted under 35 U.S.C. 154(b) by 0 days.

(21) Appl. No.: 14/998,335

(22) Filed: Dec. 31, 2015

(51) Int. Cl.
*E04C 1/39* (2006.01)
*E04C 1/00* (2006.01)

(52) U.S. Cl.
CPC ..... *E04C 1/395* (2013.01); *E04C 1/00* (2013.01)

(58) Field of Classification Search
CPC ..... E04C 1/00; E04C 1/395
See application file for complete search history.

(56) References Cited

U.S. PATENT DOCUMENTS 112,925 A * 3/1871 Johnson ..... E04B 2/42 52/505
1,431,318 A * 10/1922 Martin, Jr. ..... E04B 2/08 52/592.3
1,565,537 A * 12/1925 Wells ..... E04B 2/30 52/567
2,241,169 A * 5/1941 Yokes ..... E04B 1/12 52/223.7
2,351,768 A * 6/1944 Kaping ..... E04B 2/08 52/189
3,116,570 A * 1/1964 Torricelli ..... E04B 2/04 52/284
3,557,505 A * 1/1971 Kaul ..... E04B 2/30 52/249
3,562,988 A * 2/1971 Gregoire ..... E04B 2/08 52/279
4,026,086 A * 5/1977 Langley ..... E04B 2/06 335/306
4,041,670 A * 8/1977 Kaplan ..... E04B 2/18 446/114
4,372,091 A * 2/1983 Brown ..... E04B 2/46 52/592.6
4,704,832 A * 11/1987 Vassiliadis ..... E04B 2/22 52/279
5,230,195 A * 7/1993 Sease ..... E04B 2/18 52/309.9
6,758,020 B2 * 7/2004 Cerrato ..... E04B 1/703 52/223.7
7,882,674 B2 * 2/2011 Craven ..... E04B 2/18 446/124
8,800,236 B2 * 8/2014 Yong ..... E01C 5/00 52/574
8,869,487 B2 * 10/2014 Haintze ..... E04B 2/08 52/591.1

FOREIGN PATENT DOCUMENTS

AT 514303 B1 * 6/2015 ..... E02B 3/14
CA 2459236 A1 * 9/2005 ..... B28B 1/14
CA 2852645 A1 * 12/2013 ..... E04C 1/00

* cited by examiner

*Primary Examiner* — Babajide Demuren

(57) ABSTRACT

Building builds with locking features for adjoining and interlocking similar adjacent building blocks without any mortar using protruded means and channel means. The building blocks can vary in size and shape to form corners, octagons, angles and direction change.

1 Claim, 1 Drawing Sheet

ENCOMPASSING MORTARLESS LOCKING BLOCKS

FIELD OF APPLICATION OF THE INVENTION

This invention relates to the field of modular blocks such as those used in building a wall with mortar.

DESCRIPTION OF THE INVENTION

Encompassing lock blocks are composed of extension means, channel means, protruded means, and recess means. The protruded means bordering the recess means. Two recesses are disposed in the extension means and one recess in the rear channel means. When the extension means engages the channel means, the protruded means engage the recesses.

The block consists of three sections, the face, center and back. The face and center are of equal size while the back half the length of the face. The center becomes the extension when raised up and forward between the face and back creating the channel.

When multiple building block with the features disclosed above are staggered to create a wall, the blocks lock with surrounding blocks such that no mortar or skill is required for assembly. Blocks will automatically align when a first course is properly set into a footing and leveled.

It is believed there are no other blocks or bricks with these feature which require no mortar or skill for assembly.

DETAILED DESCRIPTION

Figure 1:
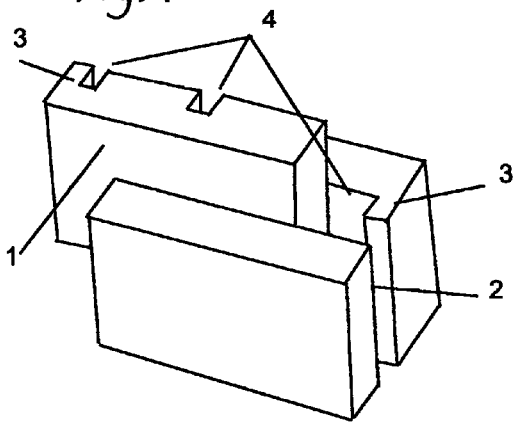
FIG. 1 shows the main block.

The drawing of FIG. 1 shows a face of the block that will be the exterior wall and look like a brick.

Figure 2:
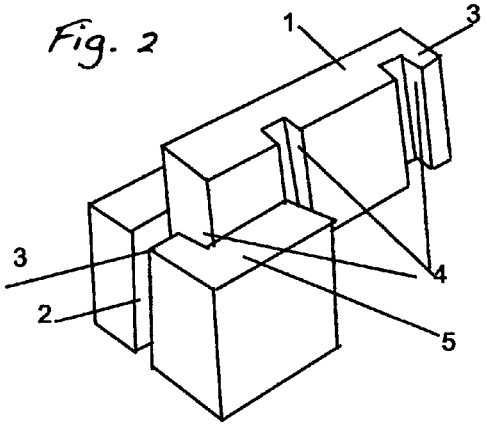
FIG. 2 shows a view of another embodiment of the main block.

The drawing of FIG. 2 shows the rear view that is the interior and means (5) on which a longitudinal will rest.

Figure 3:
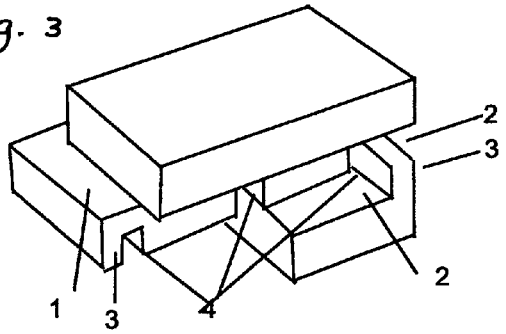
FIG. 3 shows another view of the main block of FIG. 2.

The drawing of FIG. 3 shows the bottom view at an angle; the channel means (2), protrusion means (3), and recesses means (4). The rear protrusion means (3) in the extension mean (1) is locked into the channel (2) of a next course. When blocks are staggered, each block locks into adjacent blocks on both sides, one above, and one below. The short back section of the block provides a rest means (5) on every course of the wall for a longitudinal or U beam. When assembled the interior will look like a checkerboard. Means (5) providing a space between each block to provide structural support and the rest for ceilings and floor beams.

The building blocks automatically align when a first course is properly set into a footing and leveled. There is no possibility the face to loosen from the blocks center, therefore, no falling bricks.

Figure 4:
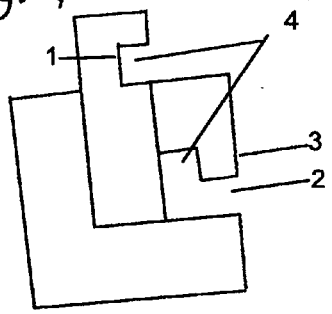
FIG. 4 shows a top view of a half block.
Figure 5:
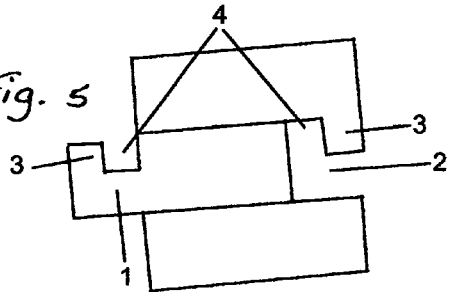
FIG. 5 shows a top view of another embodiment of the half block.
Figure 7:
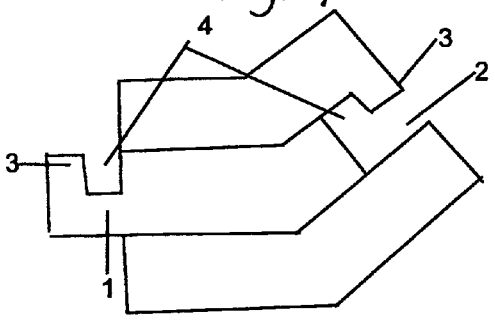
FIG. 7 shows a top view of an angle block

The drawing of FIGS. 4, 5, and 7 shows corner blocks and angle blocks that can be made into square and octagon pillars, and also to change direction of a wall structure. All the blocks shown have the same interlocking features, which is Means 1 thru 4, with the exception of means 5.

Figure 6:
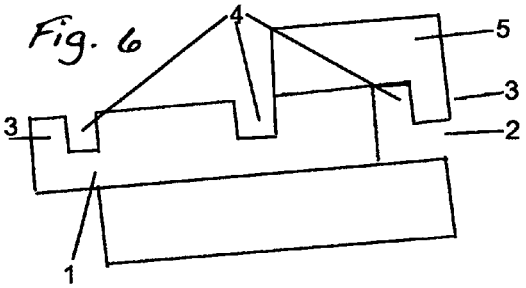
FIG. 6 shows a top view of FIG. 1.

The drawing of FIG. 6 shows a top view of the block that will be the exterior wall.

The described features allow the building blocks to automatically align with a first course set into a footing and leveled. There is no possibility a face would to loosen from the blocks center, therefore, no falling bricks resulting in a far more superior construction compared to mortar construction.

The invention claimed is:

1. A building block, comprising;

a rectangular member, a L-shaped member, and a rectangular extension member; wherein the rectangular extension member is sandwiched between the rectangular member and the L-shaped member;

the rectangular extension member having two opposing surfaces along a longitudinal axis of the building block, a first surface of the two opposing surfaces being a planar surface in direct contact with a major surface of the rectangular member, wherein the extension member and the rectangular member are in an offset relationship, such that a top surface, two outermost side edges, and a bottom surface of the rectangular member lay in different planes in relation to a top surface, two outermost side edges, and a bottom surface of the extension member;

a second surface of the two opposing surfaces, opposite the first surface, comprising at least one recess (4) and a protrusion (3); wherein the protrusion is defined between said at least one recess closest to a first one of the outermost side edge of the extension member and said outermost side edge;

the second surface is in direct contact with a major surface of the L-shaped member, wherein the extension member and the L-shaped member are in an offset relationship, such that a top surface and a bottom surface of said L-shaped member lay in the same plane as the top surface and bottom surface of the rectangular member but lay in a different plane with the top and bottom surface of the extension;

the L-shaped member is defined by a longer member in perpendicular connection with a shorter member to form the L-shaped member, wherein the shorter member defines a protrusion (3), and the top surface of the L-shaped member defines a rest surface (5) capable of supporting longitudinal beams;

the offset in the difference of planes between the rectangular member, extension member, and the L-shaped member creates a channel (2) for engaging a protrusion means of a substantially structurally identical block;

the building block with substantially structurally identical blocks are capable of being interlocked without mortar to form a wall, such that when a first course is set into a footing and leveled, an upper course can be set when the protrusion (3) of a building block of the second course is positioned and locked into the channel (2) of a building block of the first course.

* * * * *